United States Patent [19]

Furuta et al.

[11] Patent Number: 4,690,542

[45] Date of Patent: Sep. 1, 1987

[54] COLOR COPYING APPARATUS

[75] Inventors: Hideya Furuta, Yokohama; Yutaka Koizumi, Kawasaki; Mitsuru Mamizuka; Yoshihiro Sakai, both of Tokyo, all of Japan

[73] Assignee: Ricoh Company, Ltd., Tokyo, Japan

[21] Appl. No.: 812,947

[22] Filed: Dec. 24, 1985

[30] Foreign Application Priority Data

| | | | |
|---|---|---|---|
| Dec. 29, 1984 | [JP] | Japan | 59-276677 |
| Dec. 29, 1984 | [JP] | Japan | 59-276678 |
| Dec. 29, 1984 | [JP] | Japan | 59-276681 |
| Dec. 30, 1984 | [JP] | Japan | 59-281073 |
| Dec. 30, 1984 | [JP] | Japan | 59-281075 |

[51] Int. Cl.[4] ..... G03G 15/01

[52] U.S. Cl. ..... 355/4; 355/1; 355/8

[58] Field of Search ..... 355/4, 3 R, 1, 8, 3 TR

[56] References Cited

U.S. PATENT DOCUMENTS

| | | | |
|---|---|---|---|
| 3,690,756 | 9/1972 | Smith | 355/4 |
| 4,120,577 | 10/1978 | Watanabe et al. | 355/4 |
| 4,162,843 | 7/1979 | Inoue et al. | 355/4 |
| 4,239,370 | 12/1980 | Kurita | 355/4 |
| 4,531,828 | 7/1985 | Hoshino | 355/4 |
| 4,610,529 | 9/1986 | Koizumi | 355/4 |

*Primary Examiner*—R. L. Moses

*Attorney, Agent, or Firm*—Oblon, Fisher, Spivak, McClelland, & Maier

[57] ABSTRACT

In a color copying apparatus including a plurality of photosensitive members and a mounting table driven by a pulley, in which an original mounted on the mounting table is illuminated to expose the respective photosensitive members with reflected light from the original to thereby form latent images thereon while the mounting table travels and these images, after developed, are transferred overlappingly onto a transfer paper to produce a color copy, a distance between exposing positions for adjacent photosensitive members is an integer multiple of a peripheral length of the pulley.

7 Claims, 9 Drawing Figures

COLOR COPYING APPARATUS

BACKGROUND OF THE INVENTION

1. Field of the Invention:

The present invention relates to a color copying apparatus in which a color copy image is obtained by exposing a plurality of photosensitive members with color decomposed images of an original color image to form electrostatic latent images of the color decomposed images thereon, respectively, developing these latent images with respective color developers to form visible images and transferring these visible images on a single transfer paper in an overlapping relation.

2. Discussion of Background:

FIG. 9 shows schematically a color copying apparatus. In this apparatus, a plurality of exposiong units 52*a*, 52*b* and 52*c* are arranged along a moving path of an original 51 and a corresponding number of photosensitive members 53*a*, 53*b* and 53*c* are exposed successively thereby with color decomposed images of the original to form color decomposed electrostatic latent images thereon while the original 51 moves along its path. The latent images are developed by different color developers by developing units 54*a*, 54*b* and 54*c*, respectively, and resultant visible color images are transferred onto a transfer paper 55 carried in an opposite direction, overlappingly. Then the overlapped images are fixed, resulting in a color copy.

In such color copying apparatus, the visible images on the photosensitive members 53*a*, 53*b* and 53*c* must be transferred onto the transfer paper 55 exactly without any relative deviation. Therefore, a moving speed of the original 51, a peripheral speed of each of the photosensitive members 53*a* to 53*c* and a moving speed of the transfer paper 55 must be maintained exactly, respectively.

In order to maintain these speeds exactly, it is usual to make the moving speed of the original 51 equal to the moving speed of the transfer paper 55, to make rotational speeds of the photosensitive members 53*a* to 53*c* equal to each other as well as to minimize eccentricities of the photosensitive members with respect to respective rotary shafts 56*a*, 56*b* and 56*c* thereof.

If these matters are done ideally, there may no deviation of color decomposed images transferred onto the transfer paper. However, it may be impossible to do them practically and therefore, a degradation of color copy image quality is practically unavoidable.

In the apparatus in which the respective photosensitive members are exposed successively to form the latent images thereon while the original is moving, a mounting table on which the original is mounted is moved by a pulley and a wire wound thereon. Therefore, when the pulley is eccentric, the moving speed of the mounting table fluctuates in each revolution of the pulley althogh an average speed thereof can be maintained constant. As a result, there may be produced a small relative deviation of latent images formed on the respective photosensitive members. This is detrimental to a final color copy image transferred on to the transfer paper after the developments thereof.

SUMMARY OF THE INVENTION

In view of the state of art, an object of the present invention is to provide a color copying apparatus by which any relative deviation between latent images to be formed on respective photosensitive members at predetermined timings can be prevented and a high quality color copy image can be obtained.

According to the present invention, the above object can be achieved by a color copying apparatus comprising a mounting table on which an original is mounted and which is driven by a pulley, a plurality of exposing units each having an image exposing portion, the image exposing portions being arranged equidistantly along a moving path of the mounting table, and a photosensitive member provided corresponding to each of the exposing units, latent images being formed on the photosensitive members by the exposing units, respectively, and transferred onto a single transfer paper in an overlapped relation after developed, wherein a distance between adjacent exposing portions is a multiple (n) of a peripheral length of the pulley where (n) is an integer.

DETAILED DESCRIPTION OF THE PREFERRED EMBODIMENTS

Figure 1:
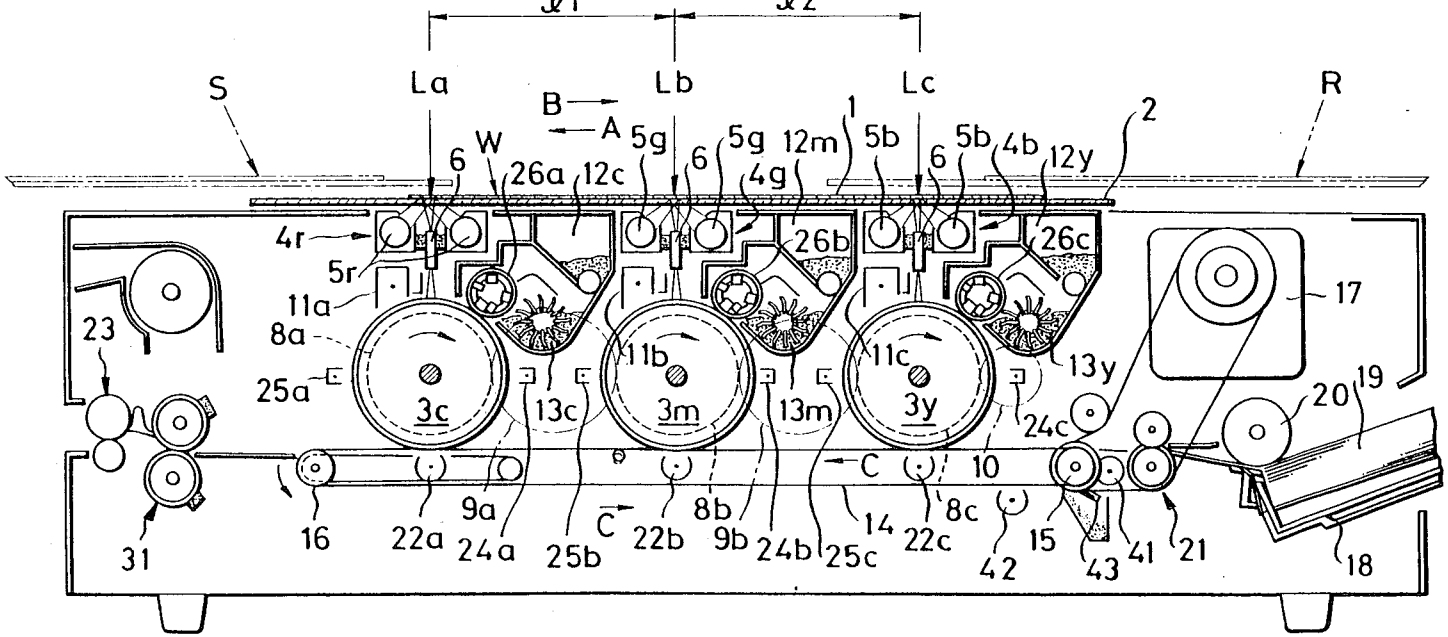
FIG. 1 is a cross sectional view of an embodiment of the present invention.

In FIG. 1 which shows an embodiment of the present invention, an original 1 having a color image thereon is mounted on a transparent original mounting table 2 with the color image side down. In a ready state during which no copying operation is performed, the mounting table 2 is positioned in a waiting position W as shown by a solid line and, upon a commencement of copying operation, it moved leftwardly as shown by an arrow A to a start position shown by a chain line S. Then, the mounting table 2 moves from the position S rightwardly as shown by an arrow B to a return position shown by a chain line R at which the moving direction of the mounting table 2 is switched to the direction A to the waiting position W. Although the mounting table 2 in these positions is shown in different levels for explanation purpose, the moving level of the mounting table 2 is common.

Below the moving path of the mounting table 2, a first, second and third photosensitive members 3*c*, 3*m* and 3*y*, in the form of drum having a common diameter, are arranged equidistantly and a first, second and third exposing units 4*r*, 4*g* and 4*b* are arranged between the moving path of the mounting table 2 and the respective photosensitive drums 3*c*, 3*m* and 3*y*. Each photosensitive drum is supported rotatably by a shaft and a distance between the shafts supporting adjacent ones of the photosensitive drums is equal to a half of a peripheral length of the drum. The exposing units 4*r*, 4*g* and 4*b* are equipped with arrays 6 of light condensing and transmitting element, or gradient-index rod lenses array, respectively. The exposing units 4r, 4g and 4b have illumination lamps 5r, 5g and 5b, respectively. The lamp 5r of the first exposing unit emits red light, the lamp 5g of the second exposing unit emits green light and the lamp 5b of the third exposing unit emits blue light. Lights from the lamps 5r, 5g and 5b are condensed to image exposing portion L*a*, L*b* and L*c* which have small width and are arranged on a moving path of the mounting table 2, respectively, to illuminate the original 1 on the mounting table 2 successively.

During a time period for which the mounting table 2 moves from the start position S in the direction B, the original 1 on the mounting table 2 is illuminated by the first, second and third lamps 5r, 5g and 5b in the image exposing portion L*a*, L*b* and L*c* successively in the order and lights reflected by the original 1 are passed through the arrays 6 of light condensing and transmitting elements provided in the respective exposing units 4r, 4g and 4b to the respective photosensitive drums to expose the letters. In this case, the reflected lights from the original 1 bear color decomposed images, respectively, and therefore, the photosensitive drums are exposed with these color decomposed images, respectively.

The color decomposed images focussed on the respective photosensitive drums 3c, 3m and 3y through the arrays 6 are in mirror-relations to the image on the original 1 mounted on the mounting table 2, i.e., in relations in which the color decomposed images are not inverted with respect to the moving direction (B) of the original. Therefore, in order to focus images on the respective photosensitive drums 3c, 3m and 3y without deviation, portions of the photosensitive drums 3c, 3m and 3y which are in the exposing position must move in the same direction as the moving direction of the original. In FIG. 1, the respective photosensitive drums 3c, 3m and 3y are driven to rotate clockwisely.

Figure 2:
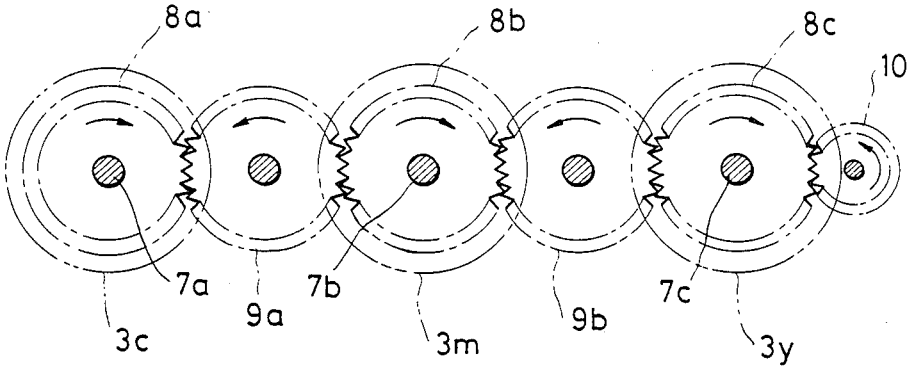
FIG. 2 illustrates an example of a driving means for driving photosensitive members in FIG. 1.

FIG. 2 illuminates an example of a drive means for driving the photosensitive drums 3c, 3m and 3y clockwisely. In this example, rotary shafts 7a, 7b and 7c of the respective photosensitive drums 3c, 3m and 3y are provided thereon with gears 8a, 8b and 8c having the same diameter, respectively. The gears 8a and 8b are meshed with an intermediate gear 9a having the same diameter as that of the gear 8a, respectively, and the gears 8b and 8c are meshed with an intermediate gear 9b which is identical to the gear 9a. The gear 8c meshes with a drive gear 10 so that a gear train composed of the gears 8a, 8b and 8c and the intermediate gears 9a and 9b is driven thereby. That is, when the drive gear 10 is rotated counterclockwisely, the gear 8a, 8b and 8c are rotated clockwisely to thereby rotate the photosensitive drums clockwisely.

The photosensitive drums 3c, 3m and 3y rotating clockwisely are uniformly charged electrostatically by electrostatic chargers 11a, 11b and 11c provided in upstreams sides of the exposing positions, respectively, prior to the exposures with the color decomposed images by the exposing units 4r, 4g and 4b as shown in FIG. 1. When the photosensitive drums 3c, 3m and 3y charged uniformly are exposed by the exposing units 4r, 4g and 4b, electrostatic latent images corresponding to the color decomposed images are formed thereon, respectively. The latent images are carried to positions facing to the developing units 12c, 12m and 12y, respectively, with the clockwise rotations of the drums. The developing unit 12c corresponding to the first photosensitive drum 3c exposed with red light contains a developer 13c of cyan color which is complimental to red, the developing unit 12m corresponding to the second photosensitive drum 3m exposed with green light contains a developer 13m of magenta color which is compliment to green and the developing unit 12y corresponding to the third photosensitive drum 3y contains a developer of yellow color which is complement to blue. Therefore, the electrostatic latent images passing through the developing units 12c, 12m and 12y are developed with respective cyan, magenta and yellow colors, so that a cyan colored visible image is formed on the first photosensitive drum 3c, a magenta colored visible image is formed on the second photosensitive drum 3m and a yellow colored visible image is formed on the third photosensitive drum 3y.

The charging, exposing and developing steps of the individual photosensitive drums 3c, 3m and 3y have been described.

It should be noted, however, that these steps for the individual photosensitive drums are performed at different timings. That is, the exposing steps for the respective photosensitive drums 3c, 3m and 3y by means of the exposing units 4r, 4g and 4b are performed at times when the original 1 reaches the exposing portion L*a*, L*b* and L*c* of the photosensitive drums, respectively. Therefore, the exposing operation is performed firstly for the first photosensitive drum 3c disposed in a most upstream side of the moving direction (B) of the original 1, then, for the second photosensitive drum and, finally, for the third photosensitive drum. A difference in time between the exposing operations for the photosensitive drums 3c and 3m is equal to a time necessary to move the original 1 from the exposing postion L*a* to L*b* and that between the exposing operations for the photosensitive drums 3m and 3y is equal to a time necessary to move the original from the portion L*b* to L*c*. Therefore, the charging timings and the developing timings for the respective photosensitive drums are different accordingly.

In this embodiment, a distance between adjacent exposing portions is made equal to a distance between the rotary shafts of adjacent photosensitive drums which is equal to a half of the peripheral length of the photosensitive drum. When the original 1 moves to the exposing portion L*b* and the exposing operation for the second photosensitive drum 3m starts after the exposing operation for the first photosensitive drum 3c completes at the first exposing portion L*a*, a front end portion of the latent image on the first photosensitive drum 3c is rotated by 180° and thus the development of that portion of the latent image is completed by the developing unit 12c. Similarly, at a time when the original 1 is moved from the second exposing portion L*b* to the third exposing portion L*c* and the exposing operation for the third photosensitive drum 3y is started, the front end portion of the visible image on the first photosensitive drum 3c completes one revolution and a front end portion of the visible image on the second photosensitive drum 3m is rotated by 180°. That is, the latent images the first, second and third photosensitive drums 3c, 3m and 3y are formed in the order at timings with a delay corresponding to the half peripheral length of the photosensitive drum and the visible images thereon are formed at timings with the same delay.

A transfer belt 14 made from a thin plate of such as polyester film is disposed below the photosensitive drums 3c, 3m and 3y. The transfer belt 14 takes in the form of an endless belt extended over a drive roller 15 and a driven roller 16 and is moved in a direction C by driving the drive roller 15 by means of a drive motor 17. Transfer papers 19 stored in a paper feed cassette 18 disposed in the right side of the drive roller 15 are fed one by one onto the transfer belt 14 by a paper feed roller 20 and a register roller 21 and, then, moved in the direction C with the movement of the transfer belt 14. During this movement, the transfer paper is in plane-contact with the third, second and first photosensitive drums 3*y*, 3*m* and 3*c*, in the order, successively, so that the visible images formed on these photosensitive drums by the respective transfer chargers 22*c*, 22*b* and 22*a* are transferred onto the transfer paper 19 overlappingly. A reference numeral 41 indicates a belt charging device. The transfer belt 14 is charged by the belt charging device 41 by which the transfer paper 14 is electrostatically attracted to the transfer belt 14. A reference numeral 42 indicates a discharging device for removing electrostatic charge on the transfer belt 14 and 43 indicates a cleaning device.

Discharging lamps 24*c*, 24*b* and 24*a* arranged in upstream sides of the respective transfer chargers 22*c*, 22*b* and 22*a* for reducing electrostatic charge of the respective photosensitive drums prior to the transfer operations are used to lower potentials of the photosensitive drums. Discharging lamps 25*c*, 25*b* and 25*a* arranged in downstream sides of the respective transfer chargers 22*c*, 22*b* and 22*a* are used to remove residual potentials of the respective photosensitive drums after the transfer operations and to make them ready for a subsequent cleaning operation. In this embodiment, the cleaning operation is performed by changing bias voltages applied to developing sleeves 26*c*, 26*b* and 26*a* of the respective developing units 12*y*, 12*m* and 12*c* during the developing operations, respectively.

The transfer paper onto which an image transfer from the first photosensitive drum 3*c* is completed from the transfer belt 14 by an influence of the radius of curvature of the driven roller 16 and sent to a pair of fixing rollers 31 by which the transferred images are fixed, resulting in a color copy. Then, the transfer paper is discharged from the copying apparatus by a paper ejecting roller 23.

The register roller 21 functions to stop temporarily the transfer paper sent out by the paper feed roller 20 and then feed it to the transfer belt 14 at a correct timing relative to the electrostatic latent image formed on the third photosensitive drum 3*y* so that the front end of the visible image on the third photosensitive drum 3*y* coincides with a desired front position of the transfer paper to thereby assure that the visible image is transferred onto a desired position of the transfer paper in the transfer position of the third photosensitive drum 3*y*, i.e., the position in which the transfer is performed by the transfer charger 22*c*.

As mentioned previously, since the electrostatic latent images are formed on the respective photosensitive drums 3*c*, 3*m* and 3*y* with a delay corresponding to the half peripheral length of the drum between adjacent drums, the visible images obtained by the respective developing units 12*c*, 12*m* and 12*y* have the same delay between adjacent ones thereof. That is, in this case, since the visible image on the second photosensitive drum 3*m* is formed after a time delayed from the formation of the visible image on the third photosensitive drum 3*y* by half peripheral length, the visible image on the first photosensitive drum 3*c* is formed after the same time from the visible image formation on the second photosensitive drum 3*m* and the distance between the transfer positions of the adjacent photosensitive drums is kept equal to the half peripheral length, the transferred images from the respective photosensitive drums are overlapped exactly without deviation.

It should be noted, however, that such exact overlapping can be obtained only when the electrostatic latent images are formed on the respective photosensitive drums at the predetermined timings. If these things are not correct, a resultant color copy may have color deviation even if the photosensitive drums are rotated correctly at a common constant speed and the peripheral speed of the drum is equal to the feeding speed of the transfer paper 19. In this embodiment, a deviation of latent image forming timings from those described above is prevented from occurring by constituting the driving system for the mounting table 2 such a way as shown in FIG. 3 and described below.

Figure 3:
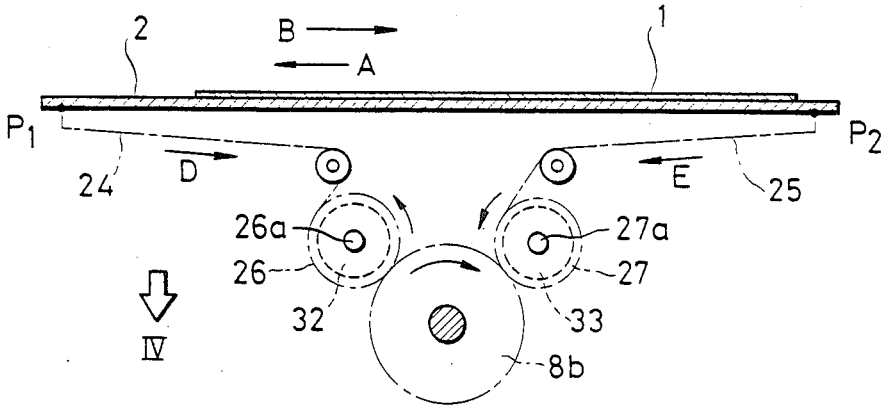
FIG. 3 illustrates an example of a driving system of a mounting table in FIG. 1.
Figure 4:
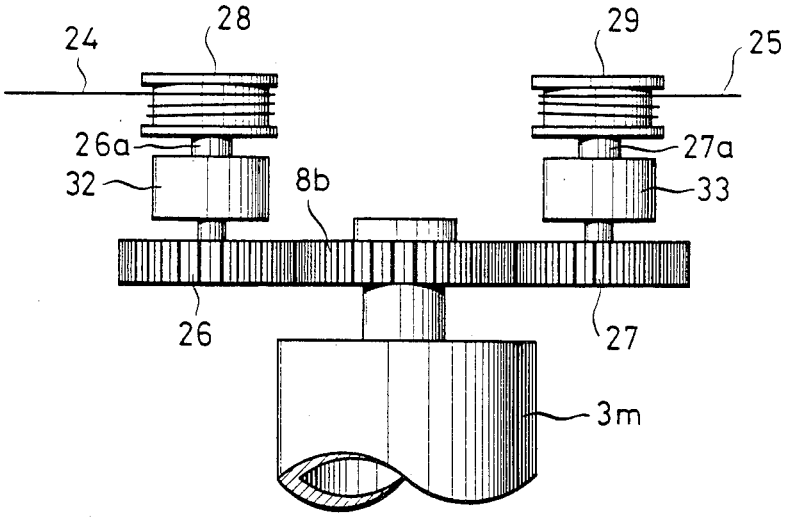
FIG. 4 is the driving system looked along an arrow IV in FIG. 3.

As shown in FIG. 3, an end of a wire 24 is connected to an end portion $P_1$ of the mounting table 2 and an end of a wire 25 is connected to the other end portion $P_2$ of the mounting table 2. The other ends of the wires 24 and 25 are wound on drive pulleys 28 and 29 (FIG. 4) mounted on rotary shafts 26*a* and 27*a* of gears 26 and 27 which mesh with the drive gear 8*b* of the second photosensitive drum 3*m* (FIG. 1), respectively. The gears 26 and 27 are coupled through electromagnetic clutches 32 and 33 to the drive pulleys 28 and 29, respectively, as shown in FIG. 4 and, thus, the drive pulleys can be rotated at a desired timing by on-off controls of the electromagnetic clutches. When the clutch 32 is made on, the wire 24 is taken in a direction D, as shown in FIG. 3, to thereby move the mounting table 2 in the direction B, i.e., from the start position S to the return position R. In this time, the other clutch 33 is in an off state and, thus, the pulley 27 is rotated by a tension of the wire 25. On the other hand, when the clutch 33 is made on, the wire 25 is taken in a direction E to move the mounting table 2 in the direction A, i.e., from the return position R to the wait position W. In this time, the clutch 32 is in an off state and, thus, the pulley 28 is rotated by a tention of the wire 24.

The image exposing operations by the exposing units 4*r*, 4*g* and 4*b* (FIG. 1) are performed while the mounting table 2 is moving in the direction B due to the take-in operation of the wire 24. In order to form the latent images on predetermined portions of the respective photosensitive drums 3*c*, 3*m* and 3*y* without deviation, the image illuminated in the first exposing portion L*a* must be illuminated in the second exposing portion L*b* at a predetermined time when the photosensitive drums complete their 180° revolutions after the illumination in the first exposing portion L*a* and illuminated in the third exposing portion L*c* at a predetermined time when the photosensitive drums complete their one revolutions after the illumination in the first exposing portion L*a*. When the outer periphery of the drive pulley 28 is a true circle and it is mounted on the shaft 26*a* without eccentricity, the mounting table 2 moves at a uniform constant speed, the timings with respect to the photosensitive drums can be kept exactly.

In practice, however, the roundness of the drive pulley 28 is not always complete and there may be a slight eccentricity of the pulley 28 on the shaft 26*a*. In this case, even if the mounting table 2 moves at the constant speed in average, there may be some local speed variation due to the eccentricity of the pulleys 28, etc. Therefore, it may be possible that the illumination in the second exposing portion L*b* cannot be done at the time when the photosensitive drums complete their 180° revolution after the illumination in the first exposing portion L*a*, resulting in that the latent image on the second photosensitive drum 3*m* is deviated from a correct position with respect to that on the first photosensitive drum 3*c*.

In order to avoid the above problem, the distances l1 and l2 between the first and second exposing portions L*a* and L*b* and between the second and third exposing portions L*b* and L*c* are made (n) times the peripheral length of the pulley 28 where (n) is an integer. That is, even if the roundness of the pulley 28 is not complete and is mounted eccentrically on the shaft, local variations of the peripheral speed of the pulley and hence the moving speed of the mounting table 2 are cancelled out at a time instance when the pulley completes each complete revolution.

Therefore, an arbitrary portion of the mounting table 2 can move from the first exposing portion L*a* by the distance l1, during the pulley 28 completes at least one complete revolution and reach the second exposing portion L*b*. This is the same for the movement l2 from the exposing portion L*b* to the exposing portion L*c*. Thus, the possible deviation of exposing timings due to the speed variations can be eliminated and therefore, any deviations between the latent images formed on the respective photosensitive drums 3*c*, 3*m* and 3*y* can be removed.

In this embodiment, the photosensitive drums 3*c*, 3*m* and 3*y* are exposed immediately when the original 1 is illuminated by the lamps 5*r*, 5*g* and 5*b* in the exposing portions L*a*, L*b* and L*c*, respectively. Further, the distances l1 and l2 are made equal to the distance between the shafts 7*a* and 7*b* of the photosensitive drums 3*c* and 3*m* and the distance between the shafts 7*b* and 7*c* of the photosensitive drums 3*m* and 3*y*, respectively. Therefore, the distance between the shaft of the adjacent photosensitive drums is an integer multiple of the peripheral length of the drive pulley 28.

The driving source for rotating the drive pulley 28 is not limited to the drive gear 8*b* of the second photosensitive drum 3*m*. For example, it may be possible to use the drive gear 8*a* or 8*c* for the first or second photosensitive drum 3*c* or 3*y* for the same purpose.

With using the gear which rotates in synchronism with the rotation of the photosensitive drum as the driving source, the movement of the mounting table 2 is easily synchronized with the rotations of the photosensitive drum 3*c*, 3*m* and 3*y*. However, in view of elimination of speed deviation of the mounting table 2 with respect to the respective exposing portions L*a*, L*b* and L*c*, it is not always necessary to use any of the drive gears 8*a*, 8*b* and 8*c* as the driving source and any other driving source may be used.

As is clear from the foregoings, after a latent image is formed on the first photosensitive drum 3*c* by the exposing unit 4*r*, the drum continues to rotate, while holding it thereon at least a portion of which may be developed, until a transfer operation of the image thereon is started after transfer operations for the photosensitive drums 3*y* and 3*m* are completed. Similarly, the second photosensitive drum 3*m* continues to rotate until the transfer operation for the third photosensitive drum 3*y* is completed. These photosensitive drums which continue to rotate while holding their images should not be in contact with the transfer belt 14, otherwise the images thereon may be damaged. Therefore, it is desired to make at least portions of the transfer belt 14 which are in contact with the first and second photosensitive drums 3*c* and 3*m* vertically shiftable such that they are rised to allow contacts with the drums only when the transfer operations therefor should be done.

Figure 5:
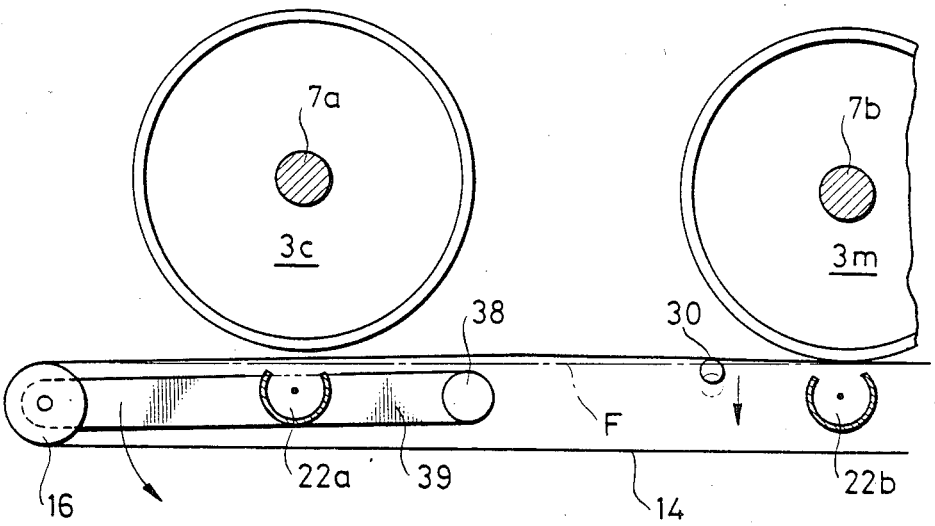
FIG. 5 shows a portion of the apparatus in FIG. 1 in an enlarged scale for explaining an operation of a transfer belt.

FIG. 5 shows an arrangement by which the transfer belt 14 is partially rised selectively. In FIG. 5, the transfer charger 22*a* for the photosensitive drum 3*c* and the driven roller 16 supporting the transfer belt 14 are supported by an arm 39 having one end rotatably supported by a pin 38 fixed to a frame (not shown) of the copying apparatus. When the arm 39 is slightly rotated counterclockwisely, it is possible to maintain the transfer belt 14 in non-contact state with the first photosensitive drum 3*c* as shown by a solid line in FIG. 5. Further, a vertically movable pin 30 is provided in an upstream side of the transfer charger 22*b* for the second photosensitive drum 3*m*. The pin 30 is set in an upper position when the transfer operation is required so that the belt becomes in contact with the drum. Otherwise, the pin 30 is set in a lower position so that the belt 14 is separated from the second photosensitive drum 3*m* as shown by a chain line F.

An mentioned, a deviation in relative positions of the latent images formed on the photosensitive drums 3*c*, 3*m* and 3*y* is eliminated by making the distance between adjacent exposing portions of the exposing units 4*r*, 4*g* and 4*b* equal to an integer multiple of the peripheral length of the drive pulley 28 for driving the mounting table and, thus, a deviation in relative color decomposed images transferred onto a transfer paper is prevented, resulting in a color copying of high quality.

The latter deviation may be produced for some other reasons than the eccentricity of pulley 28, etc. An inconsistency between the moving speed of the original 1, the peripheral speeds of the photosensitive drums and the moving speed of the transfer paper 19 may be one of examples. In such case, the following disadvantages may occur.

Figure 6:
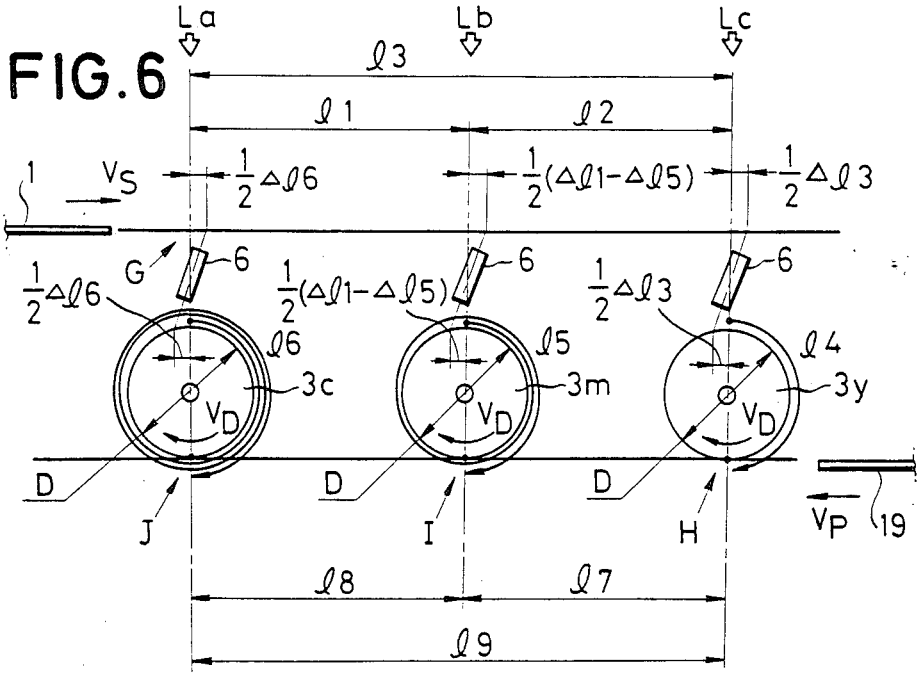
FIGS. 6 and 7 show an inclinated arrangement of an array of light condensing and transmitting members.

(1) Assuming, in FIG. 6, that the moving speed $V_S$ of the original 1 is higher than the peripheral speed $V_D$ of the photosensitive drum and there is no difference in peripheral speed between adjacent drums, the original 1 moves by a distance $l1+\Delta l1$ (l1 is a distance between the first exposing portion L*a* and the second exposing portion L*b*) during a time $t=\pi D/2V_D$, where D is a diameter of the photosensitive drum, after the exposure of the first photosensitive drum 3*c* at a position G, i.e., during a time for which the respective drums rotate by 180°. Since the exposure of the second photosensitive drum 3*m* must be performed when the original 1 moves by l1, there is produced a deviation in exposing timing by $\Delta l1$.

(2) The original 1 moves by $l3+\Delta l3$ (l3 is a distance between the first and third exposing portions L*a* and L*c*) during a time $t=\pi D/V_D$ from the exposure of the first photosensitive drum 3*c*, i.e., during a time for which the respective photosensitive drums rotate one complete revolution. Therefore, there is provided a deviation of exposure timing by $\Delta l3$ with respect to the third photosensitive drum 3*y*.

(3) Assuming that the speed $V_P$ of the transfer paper 19 is lower than the peripheral speed $V_D$, the second photosensitive drum 3*m* moves by $l5+\Delta l5$ (l5 is a peripheral moving length of the second photosensitive drum 3*m*) during a time $t=l7/V_P$, where l7 is a distance from a transfer position H of the third photosensitive drum 3*y* to a transfer position I of the second photosensitive drum, from the transfer operation from the third photosensitive drum 3*y* to the transfer paper 19, i.e., during a time for which the transfer paper 19 moves from the position H to the position I. Therefore, there is produced an image deviation of Δl5 when the transfer paper 19 receives the image from the second photosensitive drum 3*m*.

(4) The latter is the same for the first photosensitive drum 3*c*. That is, the first photosensitive drum moves by l6+Δl6 (l6 is a peripheral moving length of the first photosensitive drum 3*c*) during a time $t=l9/V_P$, where l9 is a distance from the transfer position H of the third photosensitive drum 3*y* to the transfer position J of the first photosensitive drum, during which the transfer paper 19 moves from the position H to the position J, and, thus, there is produced a deviation of Δl6.

In order to compensate for these deviation due to differences in speed, it is desired to make an angle of the optical axis of each of the light condensing transmitting element arrays 6 regulatable.

For example, the regulation of the angle for the third photosensitive drum 3*y* may be performed taking the deviation described in the item (2) above into consideration. That is, since the deviation due to the difference between the speed $V_S$ of the original and the peripheral speed $V_D$ of the photosensitive drum 3*y* is Δl3, the optical angle of the array 6 of the drum 3*y* is regulated such that a light receiving point at which light reflected from the original is received is shifted by ½(Δl3) as shown in FIG. 6. Therefore, since the light receiving point is compensated by ½(Δl3) and an exposing point on the third photosensitive drum 3*y* is corrected by ½Δl3, a correction of Δl3 of the exposing position is realized totally.

The array 6 of the first photosensitive drum 3*c* is regulated by taking the deviation in the item (4) into consideration. That is, since the deviation due to the difference between $V_P$ and $V_D$ of the first photosensitive drum 3*c* is Δl6, the optical axis of the array 6 with respect to the drum 3*c* is regulated such that the light receiving point for receiving the reflected light from the original is shifted by ½(Δl6).

The regulation of the optical axis of the array 6 of the second photosensitive drum 3*m* is performed by taking the deviations (1) and (3) into consideration. That is, since the exposure timing deviation due to the difference between $V_S$ and $V_D$ of the second photosensitive drum 3*m* is Δl1 and the transfer deviation due to the difference between $V_P$ and $V_D$ of the second photosensitive drum 3*m* is Δl5, the optical axis of the array 6 is regulated such that the light receiving point is shifted by ½(Δl1−Δl5).

Figure 7:
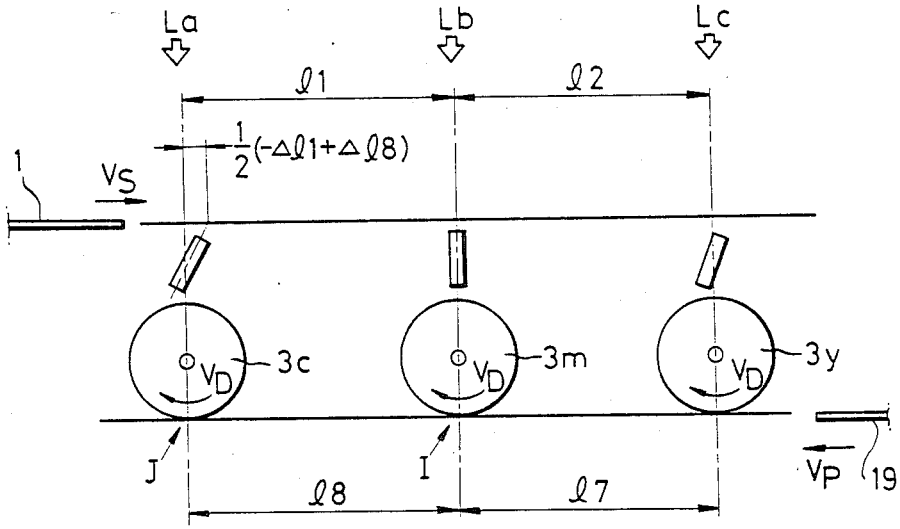

The above mentioned angle regulations of the arrays 6 are mere examples and any other regulations may be possible. FIG. 7 shows another example of the angle regulation in which the regulations are performed by using the center, i.e., second photosensitive drum as a reference. This will be described with an assumption that the moving speed $V_S$ of the original is higher than $V_D$ and the moving speed $V_P$ of the transfer paper is lower than $V_D$.

As to the angle regulation of the array 6 of the first photosensitive drum 3*c*, when the original 1 reaches the exposing portion L*b* of the second photosensitive drum 3*m* after a travel of l1, the original 1 is in advance by Δl1 with respect to the second photosensitive drum 3*m*. Therefore, it is necessary to shift the exposing portion of the first photosensitive drum 3*c* in advance by ½Δl1. At the same time, since during the transfer paper 19 moves over a distance l8 from the transfer position I to J, it is retarded by Δl8 with respect to the drum, it is necessary to form the latent image on the first photosensitive drum 3*c* with a delay of Δl8. The optical axis of the array 6 of the first photosensitive drum 3*c* is regulated by taking the above matters into consideration, such that the light receiving point is shifted by ½(−Δl1+Δl8).

For the array 6 of the third photosensitive drum 3*y*, the original is in advance by Δl2 with respect to the third photosensitive drum 3*y* and is retarded by Δl7 with respect to the second photosensitive drum 3*m* during its movement over a distance l7 between the transfer positions of the drums 3*m* and 3*y*, similarly to the latter case. Therefore, the array of the drum 3*y* is regulated such that the light receiving point is shifted by ½(Δl2−Δl7).

In the above description, the distance l1 and l2 are predetermined exactly (in the shown embodiment, l1=l2=half peripheral length of the photosensitive drum) and the distance l7 and l8 are also predetermined exactly (in this embodiment, l7=l8=half peripheral length of the drum). When there may be errors in these distances, these errors can be also compensated for by regulating the optical angles of the arrays 6.

As mentioned previously, the exposing operations for the respective photosensitive drums are performed during the mounting table 2 moves from the start position S to the return position R. Further, the exposing operations are performed for the first, second and third photosensitive drums 3*c*, 3*m* and 3*y* in the order and the transfer operations are performed for the third, second and first photosensitive drums 3*y*, 3*m* and 3*c*, in the order.

Now, a relation of the reversing timing of the mounting table 2 in the return position R to the transfer timings for the respective drums will be described.

At a time when the front end of the transfer paper 19 reaches below the third photosensitive drum 3*y*, the front end of the yellow visible image on the drum 3*y* reaches a position corresponding to the front end of the transfer paper 19. At this time, a center portion of the original 1 reaches a position above the third exposing portion L*c*. And when a rear end of the original 1 departs from the position above the third exposing portion L*c*, a center portion of the visible image reaches the transfer position. Therefore, when the mounting table 2 is reversed in direction after it moves through the third exposing portion L*c* to the return position R and is stopped temporarily thereat, the reversing timing is in a period during which the transfer operation for the third photosensitive drum 3*y* is performed.

It should be noted at this time that when the mounting table 2 is reversed in direction, there is produced a variation of load of the driving system upon which a variation of driving force for the third photosensitive drum 3*y* and vibrations are produced which affect the copy quality adversely. This becomes more severe when the mounting table 2 is reversed during the transfer operation.

In order to eliminate such problem, it is desired to stop the mounting table 2 for a while after it reaches the return position R and to reverse the direction after the transfer operation for the first photosensitive drum 3*c* is completed.

This may prolong the time necessary for a copying cycle. However, such disadvantage can be eliminated by making the returning speed of the table from the return position R to the wait position W higher.

Another approach of eliminating the image color deviation due to the transfer deviation is to develop the latent image on the photosensitive drum which is exposed lastly and subjected to the transfer operation firstly, i.e., the drum 3*y* with the yellow developer 13*y*.

That is, comparing with cyan and magenta, yellow color deviation is relatively not distinguishable from the others. Therefore, there may be no practical disadvantage even when the reversing operation of the mounting table is performed during the transfer operation of the yellow image.

The mechanism of which at least portions of the transfer belt 14 which correspond to the first and second photosensitive drums 3*c* and 3*m*, respectively, are selectively movable vertically has been described previously to avoid damages of the cyan image and magenta image thereon due to their contacts with the transfer belt 14. This mechanism can be used for another purpose also. That is, it can be used to transfer a desired color image or color images onto the transfer paper, selectively. In realizing this function, the charger of the remaining photosensitive drum (in the embodiment shown in FIG. 1, the charger 11*c* of the photosensitive drum 3*y*) is discretely on-off controlled to selectively add the yellow image.

When it is desired to obtain a copy having only yellow component, the arm 29 and the pin 30 are lowered to separate the transfer paper 19 from the photosensitive drums 3*c* and 3*m* as shown by a chain line D in FIG. 5, while the charging, exposing, developing and transfer operations for each photosensitve drum are usually performed, so that only the transfer operation for the photosensitive drum 3*y* is ordinarily performed. The yellow copy thus obtained may be utilized for preparing a plate for a color printing.

When it is desired to obtain only a magenta color copy, the arm 29 is lowered while the pin 30 is set in its upper position so that only portion of the transfer belt 14 corresponding to the first photosensitive drum 3*c* is separated from the drum 3*c*. At the same time, charger 11*c* is switched to an off state so that there is no latent image is formed on the photosensitive drum 3*y*. Thus, a copy having only magenta component is obtained.

When it is desired to obtain only a cyan color copy, the arm 29 is held in its upper state, the pin 30 is lowered and the charger 11*c* is turned off.

It may be easily understood from the above that a copy having any two color components is obtained by combining the conditions of the arm 29, the pin 30 and the charger 11*c* for any two monochromatic copies.

It is further possible in the embodiment in FIG. 1 to obtain a monochromatic copy of the original by using same developer for the respective photosensitive drums.

In the shown embodiment, the lamps 5*r*, 5*g* and 5*b* emit red light, green light and blue light, respectively. Therefore, a copy obtained in a monochromatic mode or two color mode contains other color components than the specific one or two of these three colors.

In order to copy the whole original image with a specific one or two colors, it is necessary to illuminate the original with a usual light which is reflected uniformly by the color original. That is, usual lamps are used as substitutions for the lamps 5*r*, 5*g* and 5*b*, and, when it is desired to form a latent image or latent images corresponding to a specific color component or components, usual light or lights are passed through suitable filters. An example of this arrangement is shown in FIG. 8.

Figure 8:
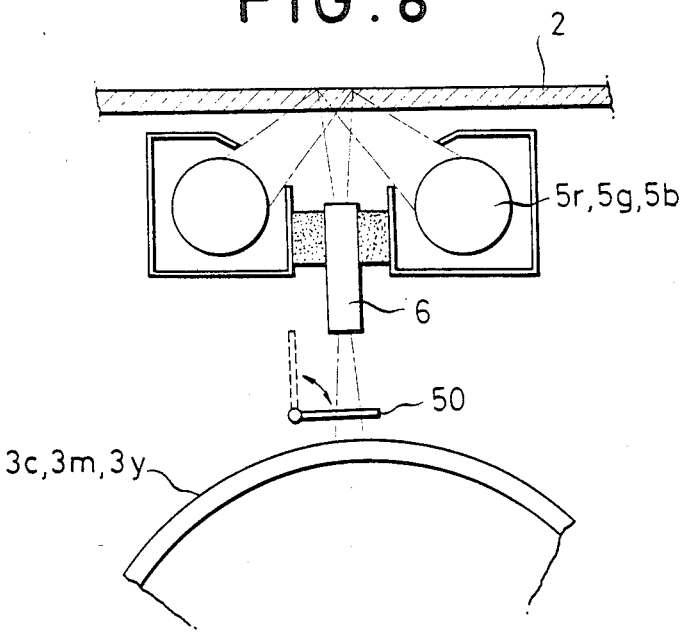
FIG. 8 is a portion of the apparatus in FIG. 1 showing a filter.
Figure 9:
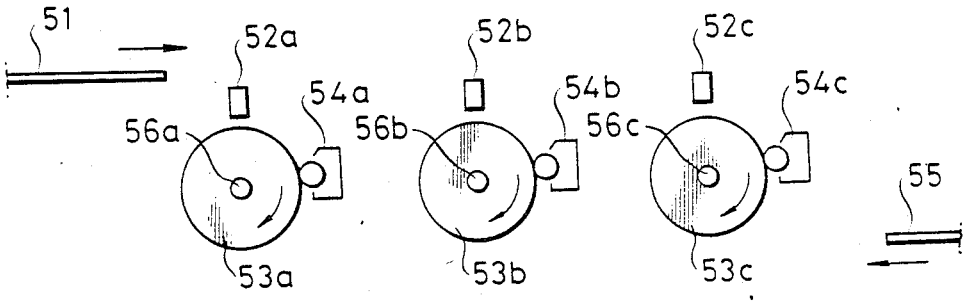
FIG. 9 is a schematic view of a copying apparatus related to the present invention.

In FIG. 8, usual light from the condensing light transmission element array 6 is passed through a filter 50 which is selectably put on the optical path. The filters 50 for the first, second and third photosensitive drums 3*c*, 3*m* and 3*y* are colored red, green and blue, respectively, so that these drums are exposed with color decomposed images, respectively, when the filters are put on the respective optical pathes. When it is desired to obtain a copy of the original with using a specific color, the filter 50 for any of the photosensitive drums 3*c*, 3*m* and 3*y* corresponding to one of the developing units 12*r*, 12*g* and 12*b* which contains the developer of the specific color is removed from its optical path to form a latent image of the whole original on the selected drum and, after the latent image is developed by the specific developer, a resultant visible image is transferred onto the transfer paper. The other photosensitive drums than the selected drum are not operated during this process.

Although, in the shown embodiment, the first and second photosensitive drums 3*c* and 3*m* are made separable from the transfer paper 19 on the transfer belt 4 and the function of the third photosensitive drum 3*y* is blocked by turning the charger 11*c* off, any of the drums can be made separable from the transmission paper and/or any of them can be inoperable by turning a corresponding charger off. Further, these conditions can be provided by any other mechanism than the arm 29 and the pin 30.

Although the present invention has been described with reference to the copying apparatus having three photosensitive drums, this invention is also applicable to any other copying apparatus which has four photosensitive drums or more.

What is claimed is:

1. A color copying apparatus comprising:

a mounting table adapted to mount an original to be copied thereon and capable of moving for exposing said original to a light;

a plurality of photosensitive members being arranged along a moving path of said mounting table;

exposing units provided correspondingly to each of said photosensitive members, and each having an image exposing portion for receiving a light image of said original exposed to each of said photosensitive members;

whereby latent images are formed by said exposing units, on said respective photosensitive members and, after said latent images are developed, resultant visible images are transferred overlappingly onto a transfer paper;

a first pulley connected, through a first clutch, with one of said photosensitive members in order to rotate;

a wire whose one end is connected with said mounting table and another end is connected with said pulley, and upon rotation of said pulley, allowing said mounting table to move for exposing said original to a light;

and wherein said image exposing portions are arranged along a moving path of said mounting table with an interval corresponding to an integer multiple of a peripheral length of said pulley.

2. The color copying apparatus as claimed in claim 1, wherein each of said exposing units includes an illumination means disposed between a corresponding one of said photosensitive members and said moving path of said mounting table for illuminating said original and an array of light condensing and transmitting elements provided with respect to said corresponding photosensitive member for directing light reflected from said original to said corresponding photosensitivemember to form one of said latent image on said corresponding photosensitive member, further comprising means for regulating an angle of optical axis of at least one of said arrays.

3. The color copying apparatus as claimed in claim 1 or 2, wherein said mounting table is movable between a wait position, a start position and a return position and exposing operations for said photosensitive members are performed during a time for which said mounting table moves from said start position to said return position and wherein said mounting table is stopped temporarily in said return position and returned after a last transfer operation for said photosensitive members completes.

4. The color copying apparatus as claimed in claim 1 or 2, wherein said mounting table is movable between a wait position, a start position and a return position and exposing operations for said photosensitive members are performed during a time for which said mounting table moves from said start position to said return position, wherein said latent iamge on one of said photosensitive members which is formed lastly and is to be transferred firstly is developed with yellow color and wherein said mounting table in said return position is returned during said transfer operation for said one photosensitive member.

5. The color copying apparatus as claimed in claim 1, further comprising a transfer belt for carrying said transfer paper whilekeeping the latter in contact with said respective photosensitive members during said transfer operations therefor and an electrostatic charger provided for each of said photosensitive members for electrostatically charging said photosensitive members to form images to be transferred, wherein a portion of said transfer belt which corresponds, in position, to a transfer position of at least one of said photosensitive members is movable to separate said portion from said one photosensitive member and said electrostatic charger corresponding to at least one of the remaining photosensitive members is on-off controllable, so that a copy of at least desired one color component can be produced by suitably moving said portion of said transfer belt and/or on-off controlling said electrostatic charger.

6. A color copying apparatus in claim 1, wherein said first pulley is connected with a central photosensitive member of said photosensitive members.

7. A color copying apparatus claimed in claim 1, further comprising:

a second pulley for moving said mounting table in return motion, and said second pulley is connected, through a second clutch, with one of said photosensitive members;

a second wire whose one end is connected with said mounting table and another end is connected with said second pulley, and upon rotation of said second pulley, allowing said mounting table to move in return motion;

whereby upon movement of said mounting table for exposing said original to a light, said first clutch turns on and said second clutch turns off, and upon movement of said mounting table in return motion, said first clutch turns off and said second clutch turns on.

* * * * *